United States Patent [19]

Liversidge

[11] 4,334,680

[45] Jun. 15, 1982

[54] GAME APPARATUS

[76] Inventor: Thomas K. Liversidge, Crescent Surf, Kennebunk, Me. 04043

[21] Appl. No.: 182,998

[22] Filed: Sep. 2, 1980

[51] Int. Cl.[3] ..... A63F 3/00; A63F 9/00

[52] U.S. Cl. ..... 273/1 GE; 273/280; 273/287; 273/236; 273/DIG. 26

[58] Field of Search ..... 273/236, 242, 243, 280, 273/287, 1 GG, 241, 1 GE

[56] References Cited

U.S. PATENT DOCUMENTS

| | | | |
|---|---|---|---|
| 1,491,520 | 4/1924 | Dailey | 273/236 X |
| 2,177,790 | 10/1939 | Scott . | |
| 2,237,707 | 4/1941 | Lazenby . | |
| 2,460,264 | 1/1949 | Prentice et al. | 273/243 |
| 2,933,315 | 4/1960 | Carr, Jr. | 273/1 GG |
| 3,195,896 | 7/1965 | Markham . | |
| 3,545,750 | 12/1970 | Stachnik | 273/1 GG |
| 3,583,701 | 6/1971 | Glass et al. | 273/1 GE |
| 3,865,381 | 2/1975 | Hayes | 273/280 X |

*Primary Examiner*—Richard C. Pinkham
*Assistant Examiner*—Scott L. Brown
*Attorney, Agent, or Firm*—Zachary T. Wobensmith, 2nd; Zachary T. Wobensmith, III

[57] ABSTRACT

Game apparatus is disclosed having a top wall with openings for the insertion of pins by two players as called for by indicia on a rotatable signal disc below the top wall but which indicia is visible through openings in the top wall, the pins may fall through the top wall and signal disc as determined by programmed openings in the disc and preferably pass through a counter for delivery by a chute to a return opening for each player, the signal disc being propelled by a spring motor during a predetermined time interval.

7 Claims, 10 Drawing Figures

GAME APPARATUS

BACKGROUND OF THE INVENTION

1. Field of the Invention

This invention relates to game apparatus for controlled discharge of pins, insertable in openings and as determined by a program on a rotatable signal disc.

2. Description of the Prior Art

Various games have heretofore been proposed having a top wall with a rotatable disc therebelow with colored indicia thereon which is displayed upon turning of the disc. Typical examples are shown in the patents to Scott, U.S. Pat. No. 2,177,790 and Lasenby, U.S. Pat. No. 2,237,707.

Markham, in U.S. Pat. No. 3,195,896 shows an indicia association game having a top wall with apertures and a disc therebelow with colored indicia displayed to control the deposit of specific colored game pieces by each player for support in the apertures as called for by the colored indicia displayed each player in turn spinning the disc. Provision is also made for the removal of a game piece upon a signal to a competing player. No time limited rotation of the disc is disclosed nor is there any provision for discharge of game pieces through apertures in the disc for scoring and, if desired, for reuse of the game pieces.

SUMMARY OF THE INVENTION

In accordance with the invention a game is provided suitable for one or two players in the specific embodiment shown, having a top wall or cover with openings for the insertion of game pieces, such as pegs, as called for by indicia on a rotatable signal disc below the top wall but with the indicia visible through openings in the top wall, the disc having programmed openings through which the inserted pins may fall for counting and for reuse, the disc being propelled by a spring motor during a predetermined time interval.

It is the principal object of the invention to provide a game which requires the attention of the player or players to respond to instructions derived from indicia, preferably of various colors, successively displayed.

It is a further object of the invention to provide a game having a rotatable signal disc which has instructions thereon which are successively displayed for movement of the game pieces and which also has provisions for discharge of the game pieces for counting.

It is a further object of the invention to provide a game of the character aforesaid in which provisions are made for transfer and counting of game pieces inserted in the top wall pursuant to instructions visible through the top wall.

It is a further object of the invention to provide a game of the character aforesaid which operates for a limited time period.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
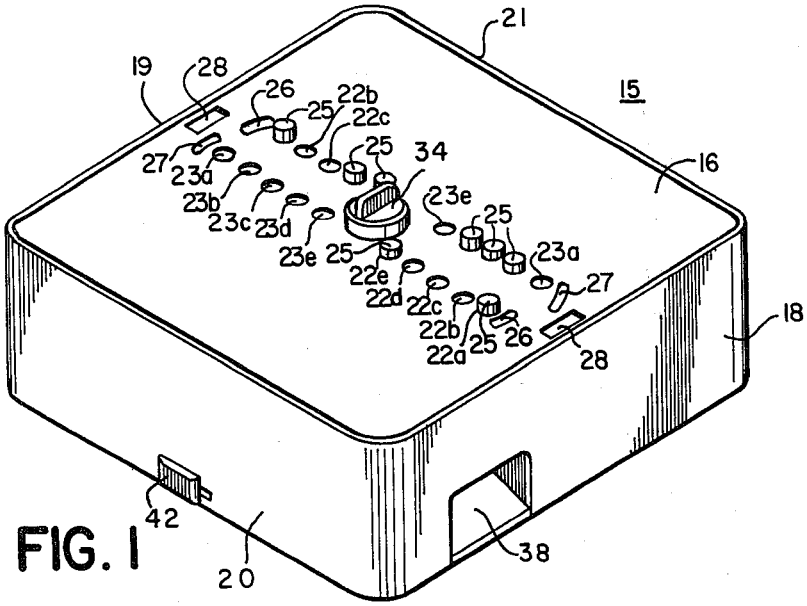
FIG. 1 is a view in perspective of game apparatus in accordance with the invention.
Figure 2:
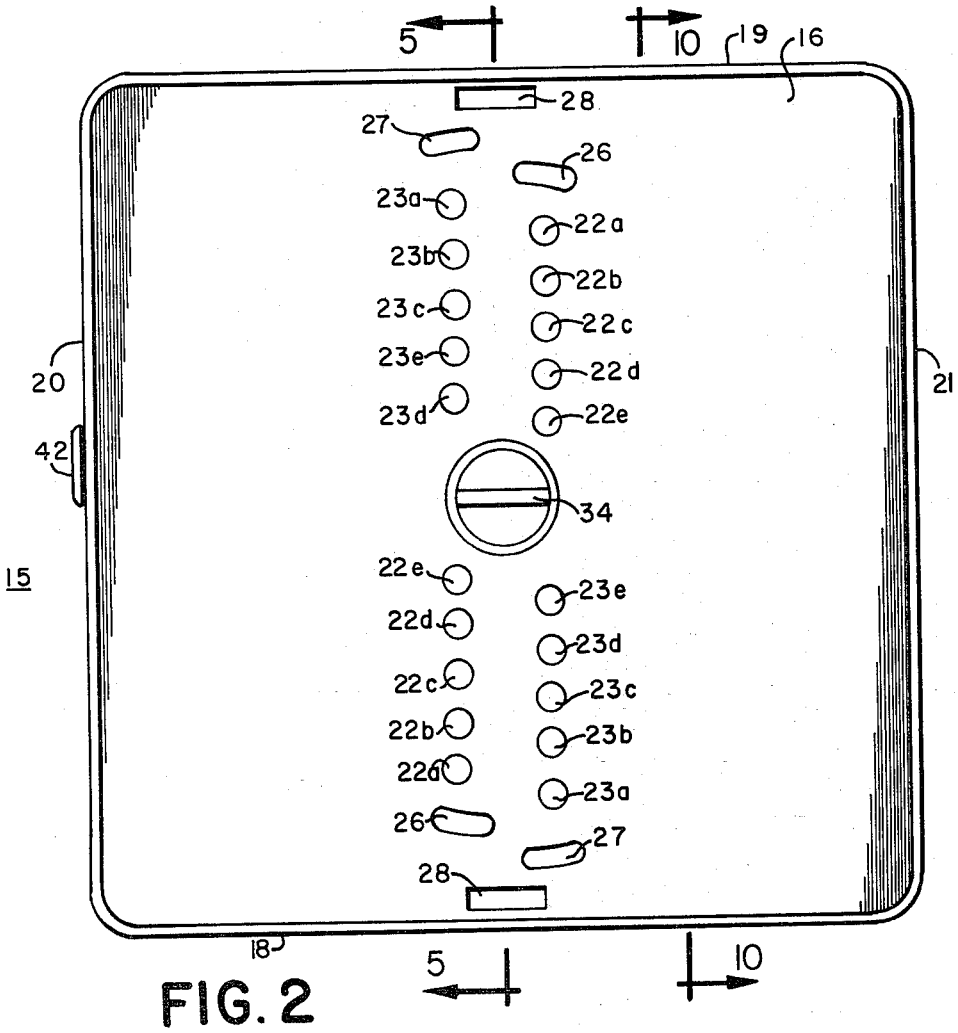
FIG. 2 is a top plan view of the game apparatus shown in FIG. 1.
Figure 4:
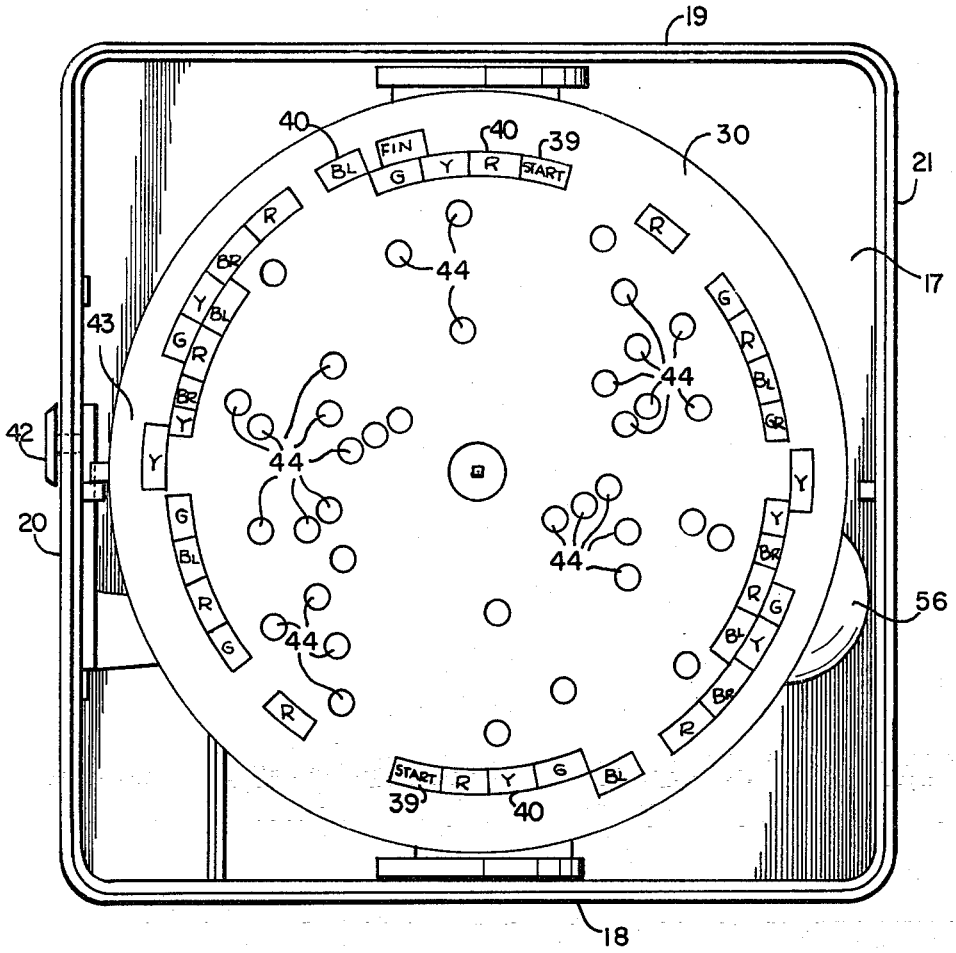
FIG. 4 is a horizontal sectional view taken on the line 4—4 of FIG. 3.
Figure 3:
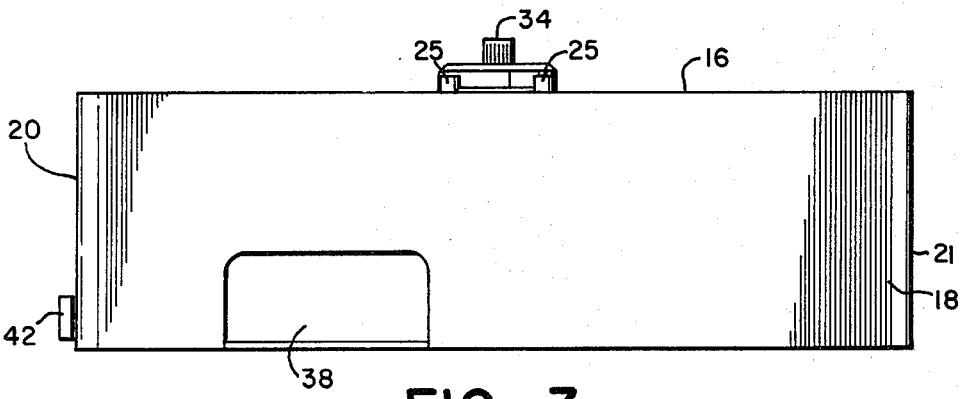
FIG. 3 is a front elevational view of the game apparatus of FIG. 1.
Figure 6:
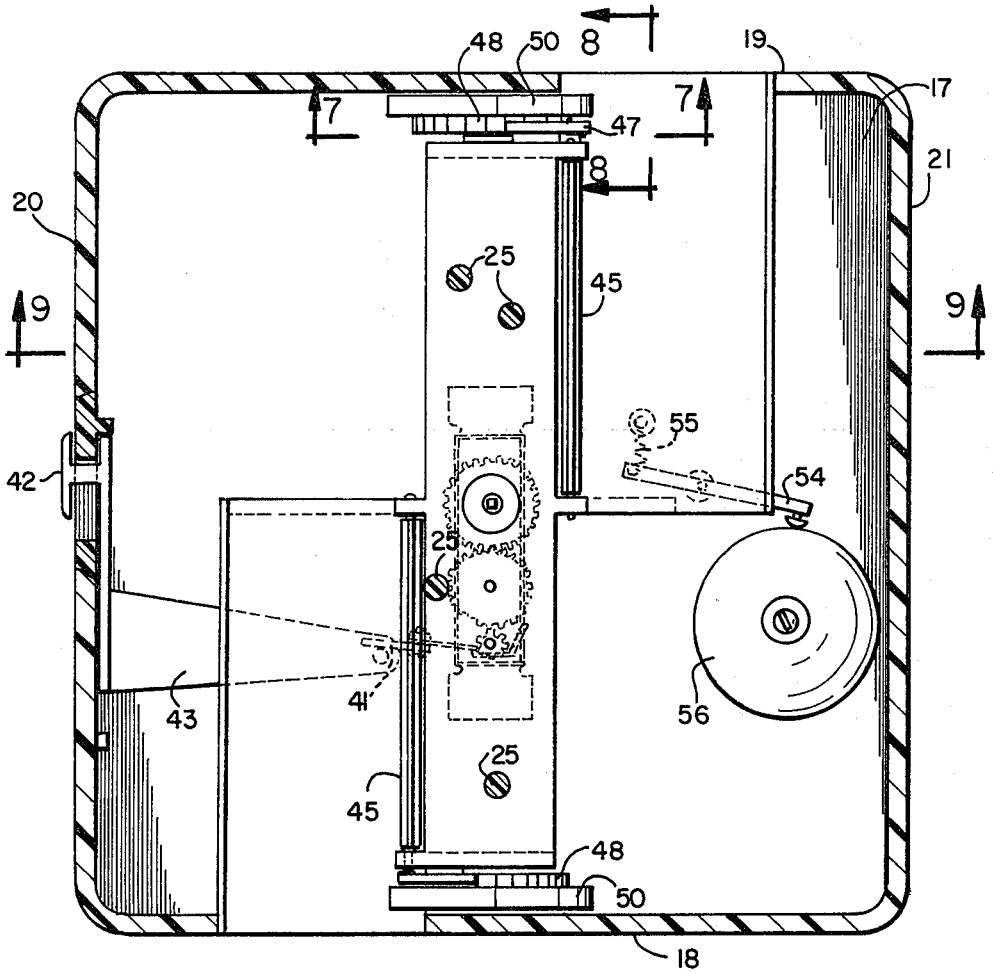
FIG. 6 is a horizontal sectional view, similar to FIG. 4 but with the rotatable signal disc removed.
Figure 5:
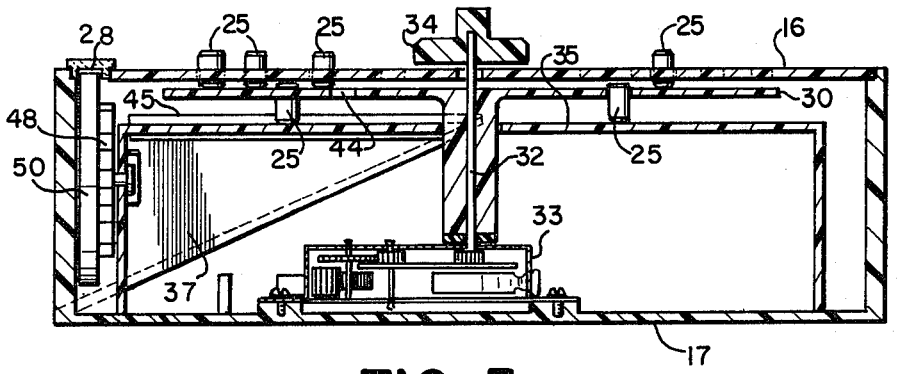
FIG. 5 is a vertical sectional view taken approximately on the line 5—5 of FIG. 2.
Figure 10:
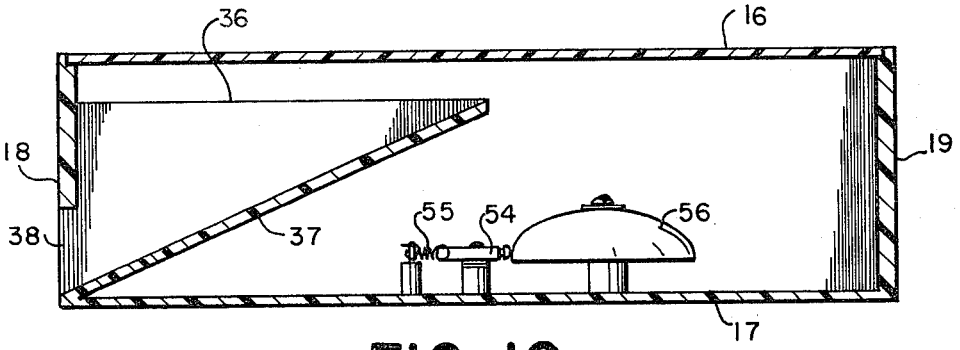
FIG. 10 is a vertical sectional view taken approximately on the line 10—10 of FIG. 2.
Figure 9:
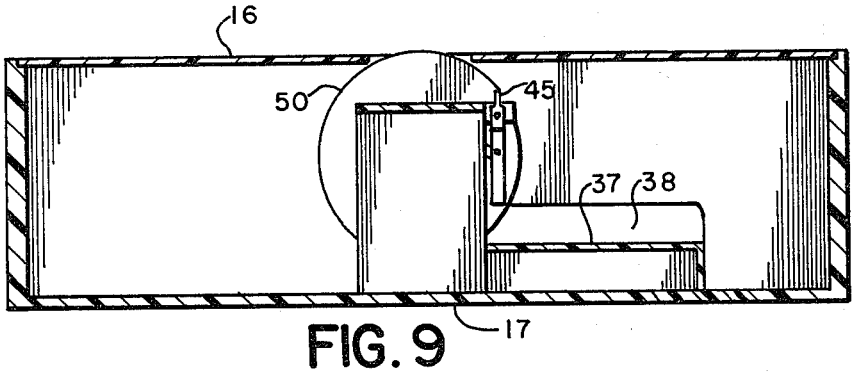
FIG. 9 is a vertical sectional view taken approximately on the line 9—9 of FIG. 6.
Figure 7:
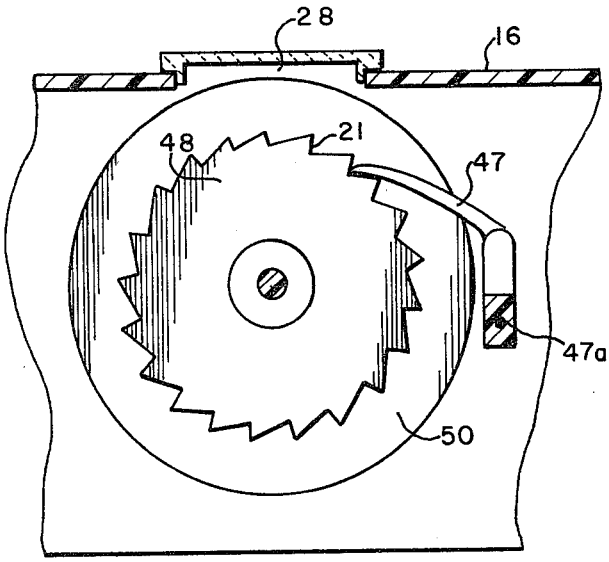
FIG. 7 is a fragmentary vertical sectional view, enlarged, taken approximately on the line 7—7 of FIG. 6.
Figure 8:
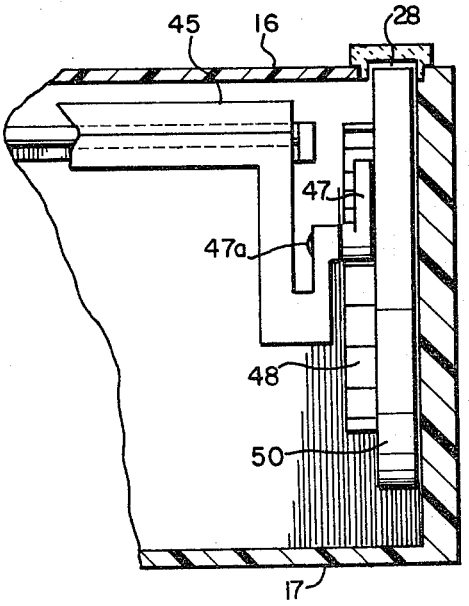
FIG. 8 is a fragmentary vertical sectional view, enlarged, taken approximately on the line 8—8 of FIG. 6.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings in which a preferred embodiment of the invention is illustrated, the game apparatus shown for use by two players, preferably includes an outer housing 15 having a top wall 16, a bottom wall 17, opposite side walls 18 and 19 and opposite side walls 20 and 21. In use by two players the side walls 18 and 19 are preferably respectively each disposed in facing relation to one of the players.

The top wall 16, for each player has a pair of parallel rows of holes 22*a* to 22*e*, and 23*a* to 23*e* respectively each of which may be identified by a distinctive color, for the insertion of pins 25 as hereinafter explained. The color designations for the holes 22 and 23 may be varied as desired but can be red, green, blue, yellow and brown.

The top wall 16 preferably has openings 26 and 27, for each player through which instructions are visible calling for the insertion of a pin 25 and may have an opening 28 for display of the number of pins 25 returned to the player below the top wall 16. A rotatable horizontal disc 30 is provided removably carried on a rotatable support 31 on a motor shaft 32 driven in a clockwise direction by a spring motor 33. An exteriorly disposed winding knob 34 on the upper end of the shaft 32, and above the top wall 16 permits winding the actuating spring of the spring motor 33. The spring motor 33 is mounted on the interior of the bottom wall 17 and has a horizontally oscillatable escapement portion 41 which is controlled by an exteriorly accessible horizontally slidable button 42 connected to an arm 43 which engages the escapement portion 41 to prevent operation of the spring motor 33.

Spaced downwardly below the disc 30, a horizontal wall 35 is provided having a terminal edge 36, and along which the pins 25 are slidable. The terminal edge 36 each communicates with a space having an inclined chute 37 connected thereto with return openings 38 on the side walls 18 and 19 for return of the pins 25 to each player.

The disc 30 has a plurality of concentric circular rings, the contents of which are visible through the opening 26, a "start" designation 39 and respective instructive indicia 40 thereon, in various colors corresponding to those applied at the openings 22 and 23, to direct the insertion of a pin 25.

The disc 30, also, at predetermined locations thereon, and for alignment with the openings 22*a* to 22*e* and 23*a* to 23*e*, has discharge or drop openings 44, which permit the pins 25 to fall for support by the horizontal wall 35 and for sliding movement therealong to and beyond the terminal edges 36. Other discs 30 with different color sequences and different drop openings 44 may be employed.

At the terminal edges 36, and for movement by pins 25 sliding along the horizontal wall 35 a counter lever 45 is pivotally mounted. The counter lever 45 has an arm 46 with a pivotally mounted actuating latch 47 carried on a pivot pin 47*a* engageable for each movement of the lever 45 with a ratchet wheel 48 secured on a shaft 49. The shaft 49 has a counter wheel 50 secured thereto with successive numbers on its periphery, preferably from 0 to 20, which are visible through the opening 28 of the top wall 16.

Movement of the counter lever 45 may also be utilized through an arm 52 to release a bell clapper 54, against the force of a spring 55 to strike a bell 56 each time a pin 25 causes actuation of the counter lever 45.

The mode of operation will be apparent from the foregoing but will be summarized briefly.

The spring of the spring motor 33 is wound by turning the winding knob 34. The button 42 is moved to clear the arm 43 from engagement with the escapement portion 41 for operation of the motor 33.

When the "start" indicia 39 is displayed pins 25 are inserted in the openings 22*a* to 22*e* and 23*a* to 23*e* as indicated by the successive color indicia displayed at the top wall openings 26 and 27.

The continued rotation of the disc 30 will bring drop openings 44 into alignment with the openings 22 and 23 so that the pins 25 will fall into engagement with the support wall 35 and be moved therealong by continued rotation of the disc 30.

As the pins 25 are advanced they cause the counter lever 45 to be tilted to actuate the activating latch 47 to advance the ratchet wheel 48 one tooth and the counter wheel 50 to advance the score displayed by the wheel 50 through the score opening 28.

Movement of the counter lever 45 is also effective to cause the bell clapper 54 to strike the bell 56.

As the pins 25 are advanced beyond the terminal edge 36 they are moved into the inclined chute 37 for return to the openings 38.

I claim:

1. Game apparatus comprising a housing having a top wall provided with openings for insertion of game pieces, said game pieces comprising pins of predetermined length, a rotatable disc below said top wall having indicia for indicating the insertion of pins in said openings and normally providing a support for inserted pins, means for continuously rotating said disc in a predetermined direction, and a fixedly mounted supporting wall for said pins beneath said rotatable disc for movement of said pins therealong, said disc having a plurality of openings for permitting downward movement of said pins for support by said supporting wall and movement therealong, said game pieces being of a length when in engagement with said supporting wall being beneath said top wall for movement by said openings in said disc.

2. Game apparatus as defined in claim 1 in which a return chute is provided for game pieces advanced along said supporting wall.

3. Game apparatus as defined in claim 1 in which counting means is provided for game pieces advanced along said supporting wall.

4. Game apparatus as defined in claim 3 in which said counting means comprises a counter member for movement by advance of game pieces along said supporting wall.

5. Game apparatus as defined in claim 3 in which said counting means comprises a visible display opening on said housing, and a member for displaying a number at said opening corresponding to the count of said game pieces.

6. Game apparatus as defined in claim 1 in which said means for rotating said disc is a spring operated motor.

7. Game apparatus as defined in claim 6 in which an exteriorly accessible member is provided for winding the spring of said spring motor.

* * * * *